US008381351B2

(12) United States Patent
Miller et al.

(10) Patent No.: US 8,381,351 B2
(45) Date of Patent: Feb. 26, 2013

(54) MOP BUCKET

(75) Inventors: Jonathan Miller, Williamsport, PA (US); Robert L. Crevling, Jr., Cogan Station, PA (US); Melvin E. Wolfe, Jr., Johnson City, NY (US); John Griffin, Phoenix, AZ (US); David Martinez, Williamsport, PA (US)

(73) Assignee: Shop-Vac, Williamsport, PA (US)

( * ) Notice: Subject to any disclaimer, the term of this patent is extended or adjusted under 35 U.S.C. 154(b) by 462 days.

(21) Appl. No.: 12/647,697

(22) Filed: Dec. 28, 2009

(65) Prior Publication Data

US 2010/0170056 A1 Jul. 8, 2010

Related U.S. Application Data

(60) Provisional application No. 61/143,323, filed on Jan. 8, 2009.

(51) Int. Cl.
*A47L 13/50* (2006.01)

(52) U.S. Cl. ..... 15/264

(58) Field of Classification Search ..... 15/260–264; 220/756, 810, 817; 206/767, 768, 45.28; D32/53–54

See application file for complete search history.

(56) References Cited

U.S. PATENT DOCUMENTS 1,275,695 A * 8/1918 Iverson ..... 220/525
2,664,584 A * 1/1954 Twerdahl ..... 15/260
3,417,861 A * 12/1968 Levy ..... 206/45.28
3,562,841 A * 2/1971 Royalty ..... 15/260
D286,096 S 10/1986 Jaros et al.
4,716,619 A 1/1988 Young
4,912,804 A 4/1990 Pasbol
D320,295 S 9/1991 Delmerico
5,333,353 A 8/1994 Taylor
5,349,720 A 9/1994 Primeau
5,414,892 A 5/1995 Clark, Jr.
5,440,778 A * 8/1995 De Guzman ..... 15/260
5,548,865 A 8/1996 Pagani
5,615,447 A 4/1997 Hardesty et al.
5,918,343 A 7/1999 Young
5,947,319 A * 9/1999 Sinski ..... 220/318
5,983,441 A 11/1999 Williams et al.
6,006,397 A 12/1999 Williams et al.
RE36,599 E 3/2000 De Guzman
6,055,698 A 5/2000 De Guzman
6,065,175 A 5/2000 Tejerina
D429,396 S 8/2000 Houry et al.
6,115,877 A 9/2000 Morad et al.
6,128,803 A 10/2000 Dickinson et al.
6,279,195 B1 8/2001 Biggs
6,283,170 B1 9/2001 Robinson
6,389,638 B1 5/2002 Dickinson et al.
6,457,203 B1 10/2002 Williams et al.
6,487,749 B1 12/2002 Tsui
6,560,815 B1 5/2003 Brennan et al.
6,662,401 B2 12/2003 Zorzo
6,671,923 B2 1/2004 Gromnicki
6,684,450 B2 2/2004 Dingert
6,823,557 B2 11/2004 Dingert
6,941,612 B1 9/2005 Hirse (Continued)

*Primary Examiner* — Nicholas Lucchesi
*Assistant Examiner* — Niyati D Shah
(74) *Attorney, Agent, or Firm* — Michael Stanley Tomsa; Katten Muchin Rosenman LLP

(57) ABSTRACT

A mop bucket assembly is disclosed which allows for moving a bucket from one position to another while reducing spillage from the bucket by using an integrated lid to keep liquid from splashing out of the bucket. The disclosed mop bucket assembly also discloses a mop bucket assembly having a caution or warning sign formed integral with the mop bucket assembly that can be deployed when mopping is in progress.

19 Claims, 22 Drawing Sheets

U.S. PATENT DOCUMENTS

| | | | |
|---|---|---|---|
| 6,996,873 | B2 | 2/2006 | Salmon |
| D527,506 | S | 8/2006 | Camp et al. |
| D536,851 | S | 2/2007 | Lauer |
| 7,171,720 | B2 | 2/2007 | Rust et al. |
| 7,178,195 | B2 | 2/2007 | Damrath et al. |
| 7,216,395 | B2 | 5/2007 | Sander |
| 7,225,499 | B1 | 6/2007 | Duncan et al. |
| D550,418 | S | 9/2007 | Weaver et al. |
| 7,318,247 | B2 | 1/2008 | Libman et al. |
| 7,383,604 | B2 | 6/2008 | Young |
| 2003/0167589 | A1 | 9/2003 | Dingert et al. |
| 2006/0010637 | A1 | 1/2006 | Duncan et al. |
| 2006/0032011 | A1 | 2/2006 | Young |
| 2006/0085939 | A1 | 4/2006 | Petner |
| 2006/0277709 | A1 | 12/2006 | Young |
| 2007/0022559 | A1* | 2/2007 | Dalton ..... 15/261 |
| 2007/0084009 | A1 | 4/2007 | Bensussan |
| 2007/0226942 | A1 | 10/2007 | Damrath et al. |
| 2007/0289084 | A1 | 12/2007 | Damrath et al. |
| 2007/0294853 | A1 | 12/2007 | Escarpa Gil |

* cited by examiner

MOP BUCKET

RELATED APPLICATION

This application claims priority to U.S. provisional patent application Ser. No. 61/143,323, filed Jan. 8, 2009, which is hereby incorporated herein by reference in its entirety.

BACKGROUND

Mop buckets have the problem that when they are moved from place to place, the water or liquid inside the mop bucket splashes around inside the bucket and often over the sides of the bucket, which has the tendency to dirty the area the was just mopped or to create a slipping hazard. Also, when someone using the bucket is mopping, they often need to put out a "caution" sign to warn others that the area is slippery. Typically, this sign is separate from the bucket and needs to be carried separately.

Accordingly, there is a need for a mop bucket that reduces side-spillage while the bucket is being moved and which also allows enough space for the mop to be inserted into the bucket unencumbered. Also, there is another need for a mop bucket that integrates a warning or caution sign into the bucket.

SUMMARY

According to one aspect of the present invention, a mop bucket assembly includes a bucket portion and a handle portion where the handle portion includes a moveable lid that helps contain water or liquid within the bucket when the bucket is in transit and when the bucket is stopped in a location for mopping, the lid can be flipped to allow the mop full access to the bucket. The flipped lid may also include a "caution" or other warning sign, so that when the bucket is in a stopped position, the flipped lid acts as a warning sign.

DESCRIPTION OF THE DRAWING

These and other advantages of the present invention will be readily understood with reference to the following specification and attached drawing wherein.

DETAILED DESCRIPTION

Figure 1:
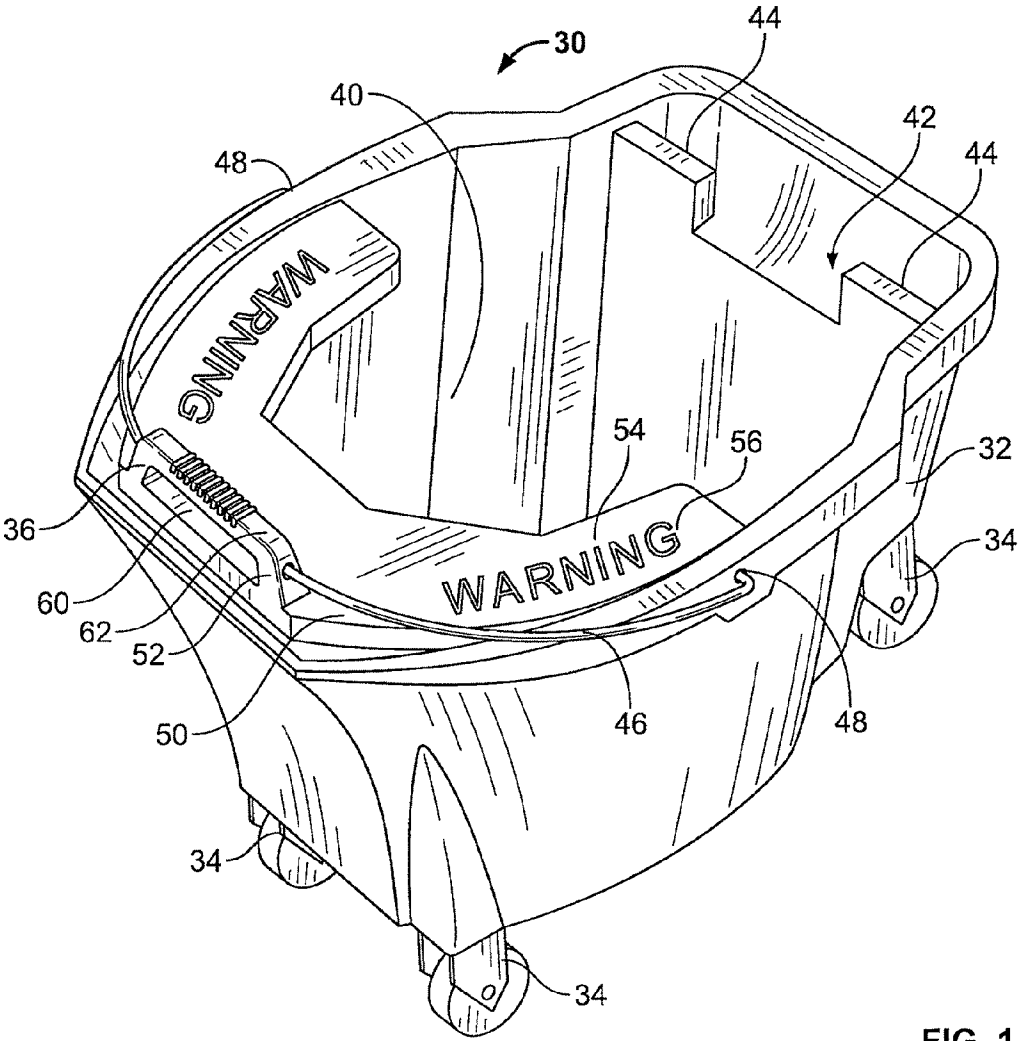
FIG. 1 is a front perspective view of a first embodiment of a mop bucket of the present invention.
Figure 3:
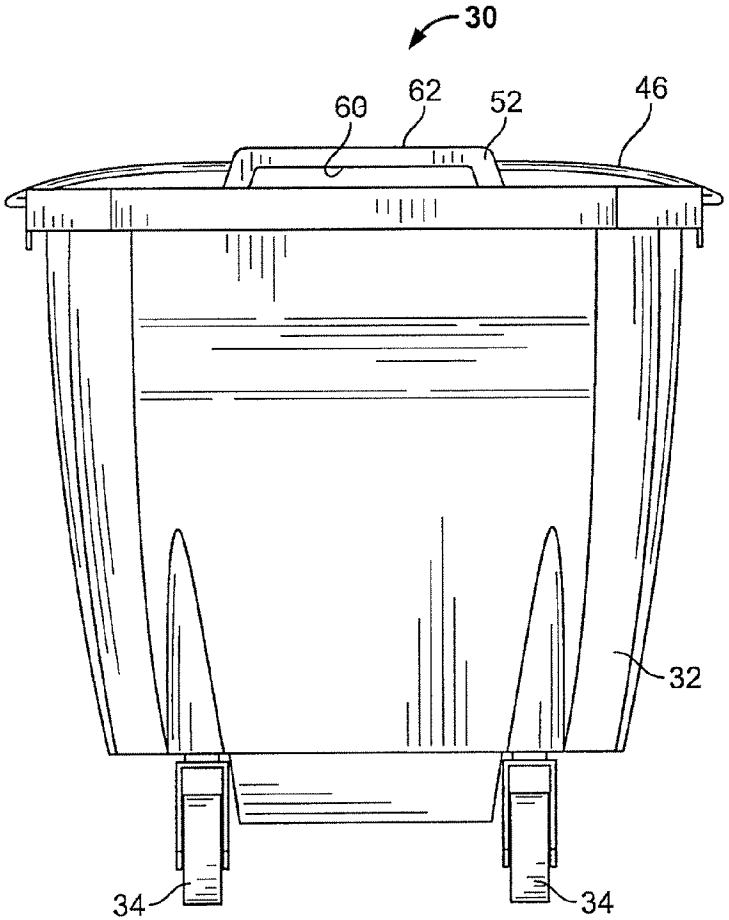
FIG. 3 is a rear elevational view of the first embodiment of the present invention.
Figure 2:
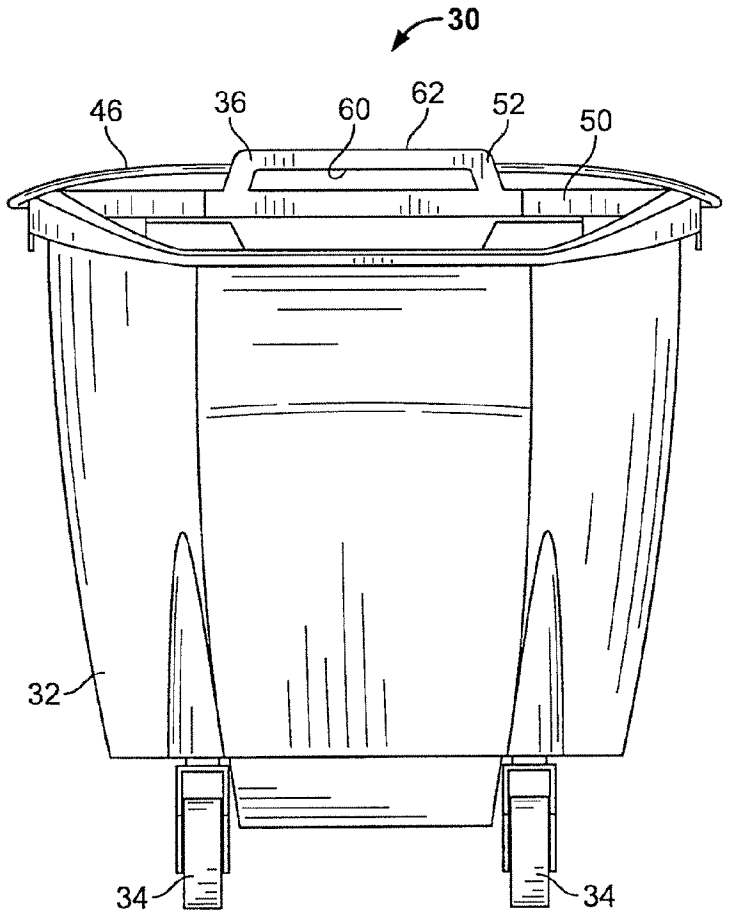
FIG. 2 is a front elevational view of the first embodiment of the present invention.
Figure 4:
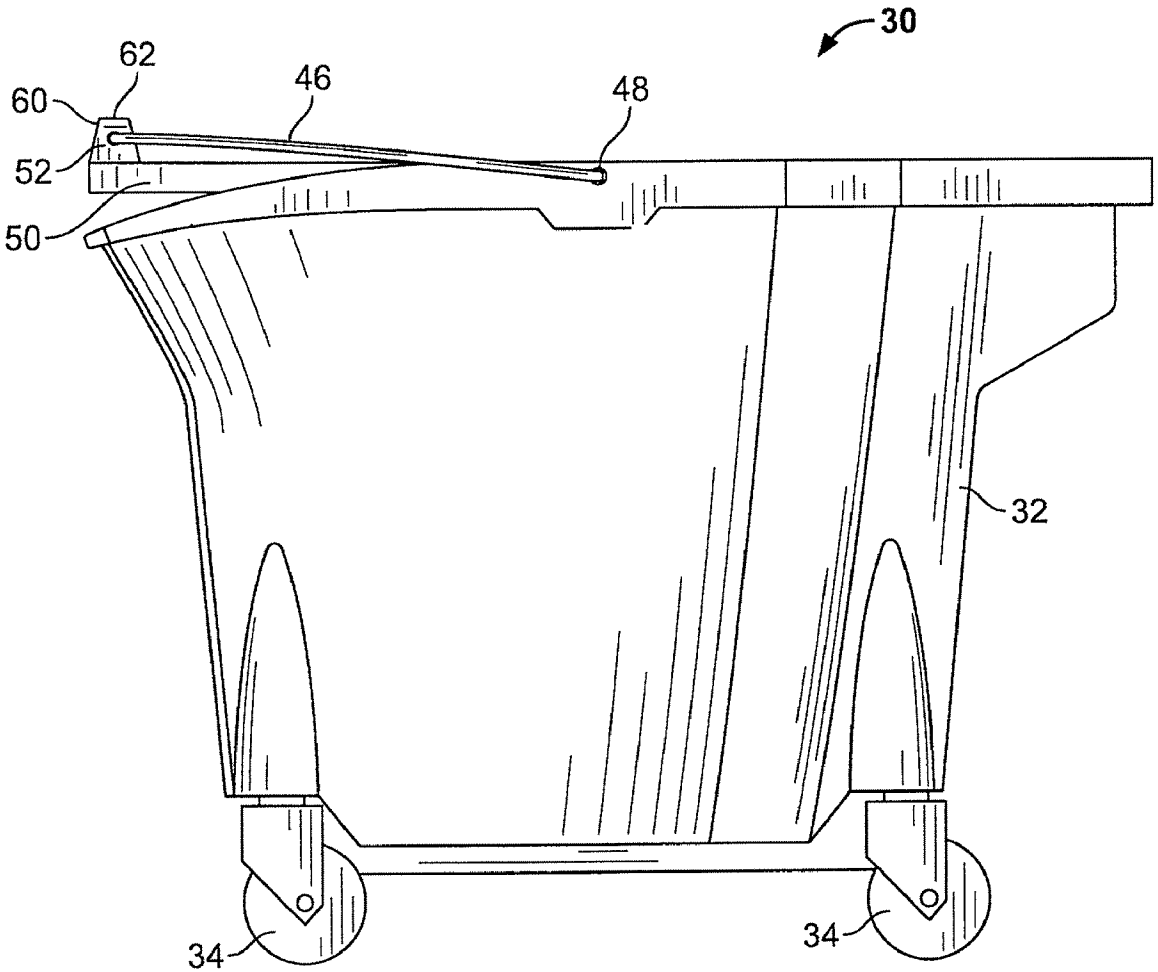
FIG. 4 is a right side elevational view of the first embodiment of the present invention.
Figure 5:
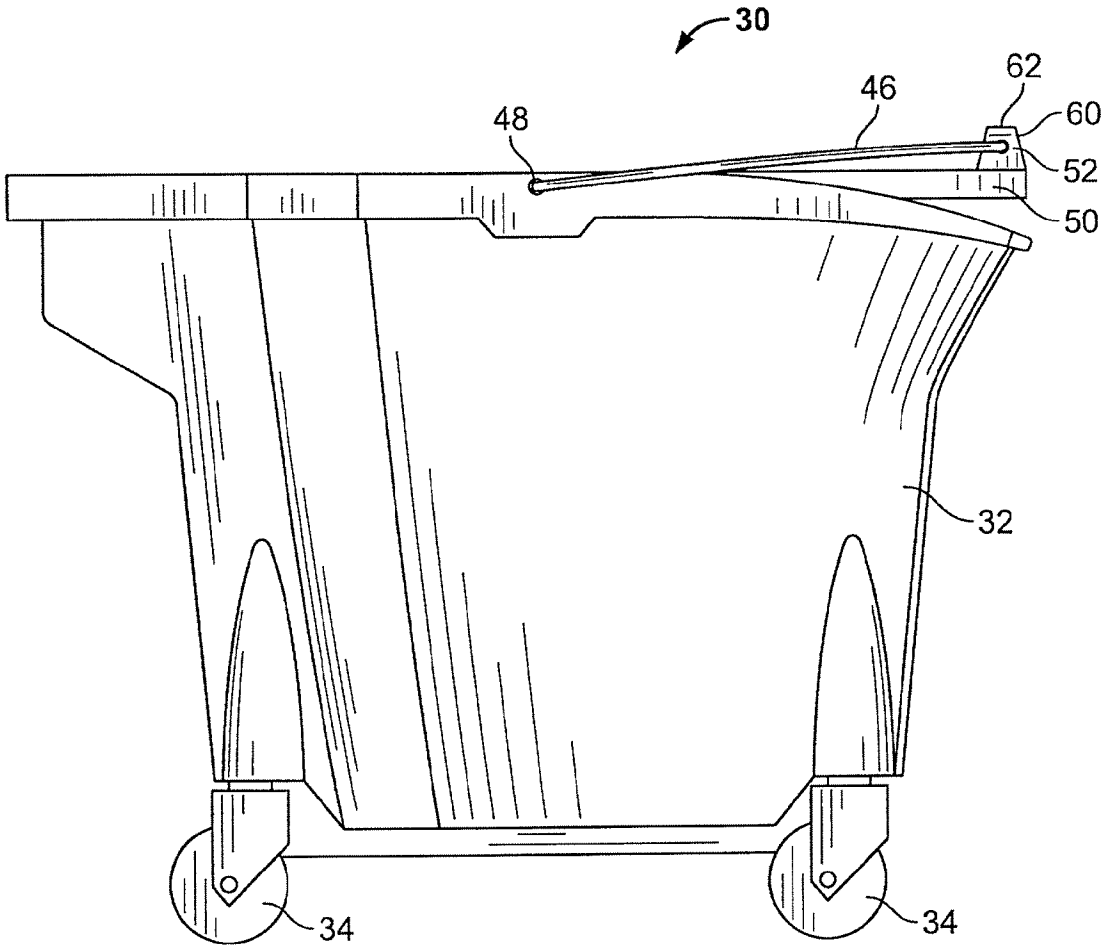
FIG. 5 is a left side elevational view of the first embodiment of the present invention.
Figure 6:
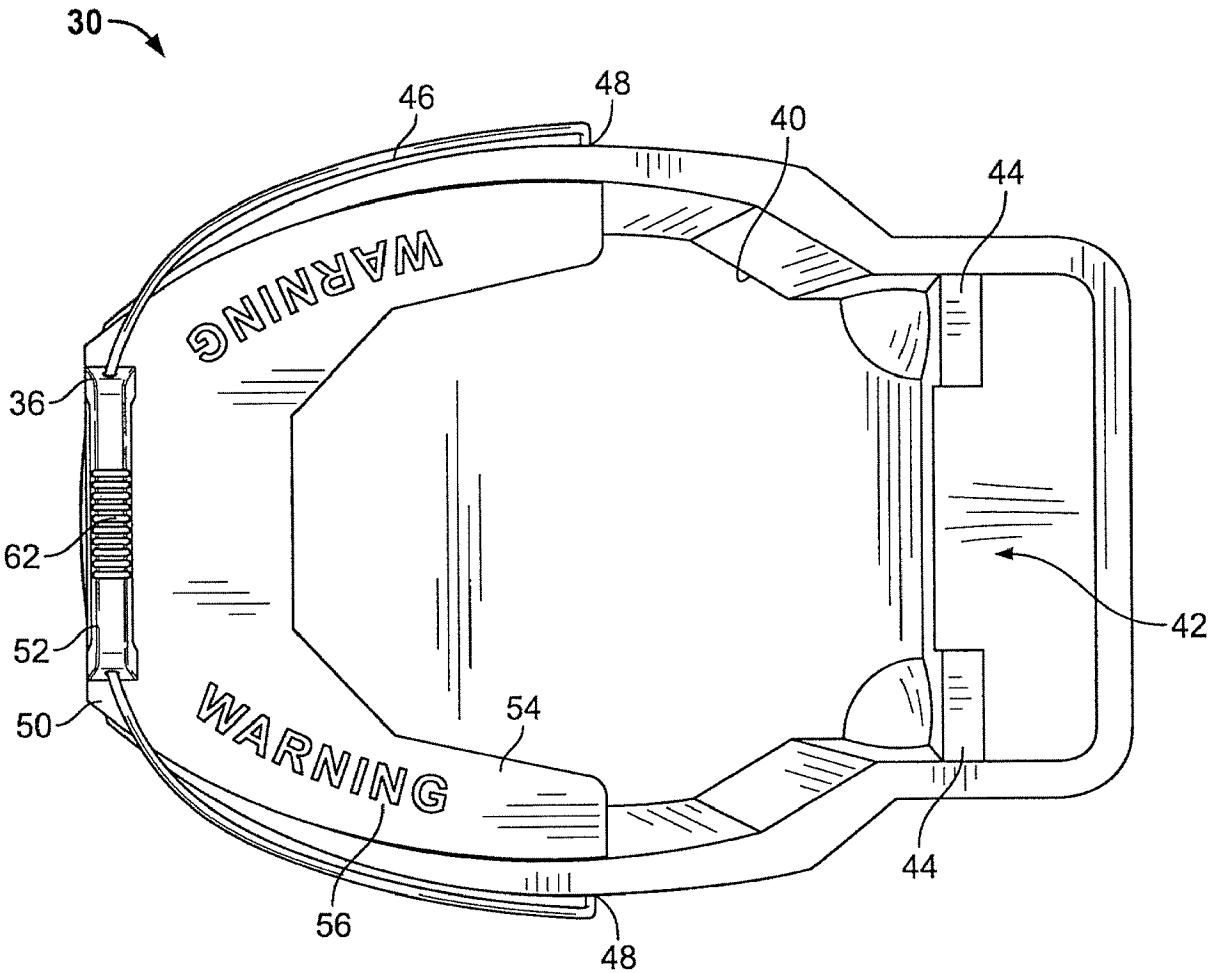
FIG. 6 is a top plan view of the first embodiment of the present invention.
Figure 7:
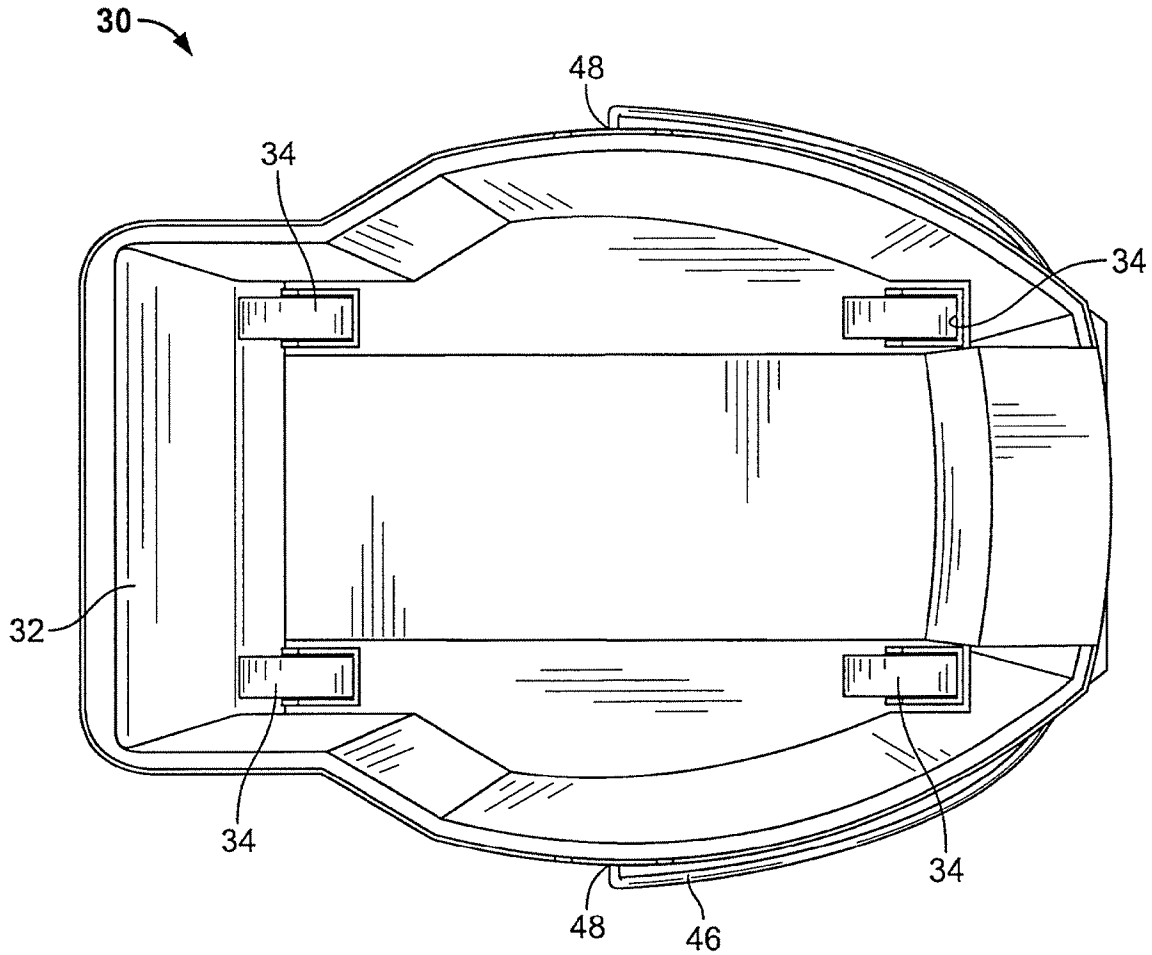
FIG. 7 is a bottom plan view of the first embodiment of the present invention.
Figure 8A:
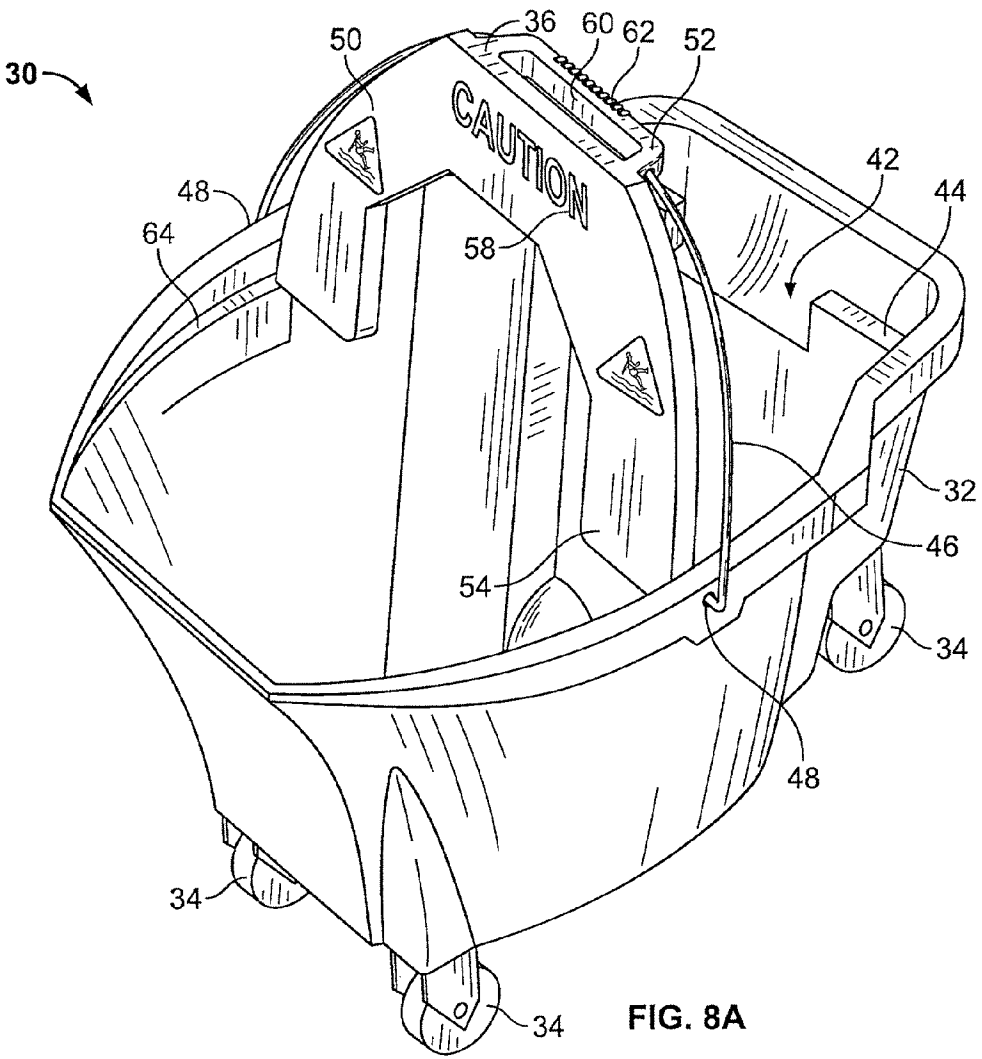
FIG. 8A is a front perspective view of the first embodiment of the present invention with a handle in an up position.

Referring to FIG. 1, an embodiment of a small version of the mop bucket assembly 30 of the present invention is depicted. The mop bucket assembly 30 includes a bucket portion 32, a number of wheels 34 and a handle assembly 36. The bucket portion 32 includes a liquid retaining recess 40 and a wringer support 42. In this embodiment, the wringer support 42 includes two support protrusions 44 which support a wringer when it is put in place within the bucket assembly 30. The handle assembly 36 in this embodiment includes a wire handle portion 46 which connects with the bucket portion 32 through holes 48 formed in the bucket portion 32. The handle assembly 36 also includes a lid assembly 50. The lid assembly 50 includes a grip portion 52 and a lid portion 54. The lid portion 54 can have signage on its top 56 and bottom surfaces 58 (FIG. 8A). FIG. 1 depicts the mop bucket assembly 30 in a traveling position with the lid portion 54 covering the front of the liquid retaining recess 40. In this configuration, liquid in the retaining recess 40 is retained within the bucket portion 32 and restrained from spilling over the sides of the bucket portion 32 when the mop bucket assembly 30 is moved.

Figure 8B:
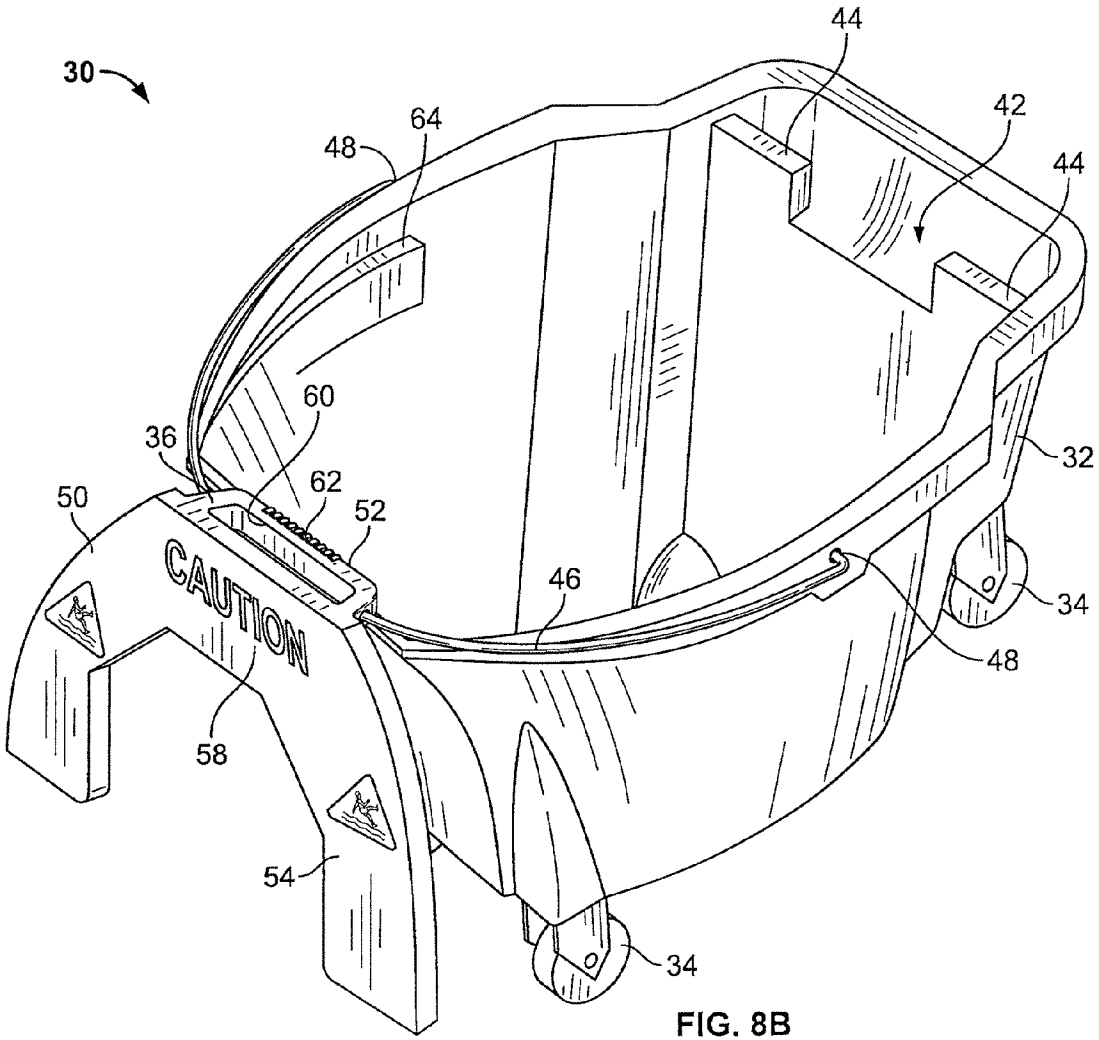
FIG. 8B is a front perspective view of the first embodiment of the present invention with a warning sign in a deployed position.
Figure 9:
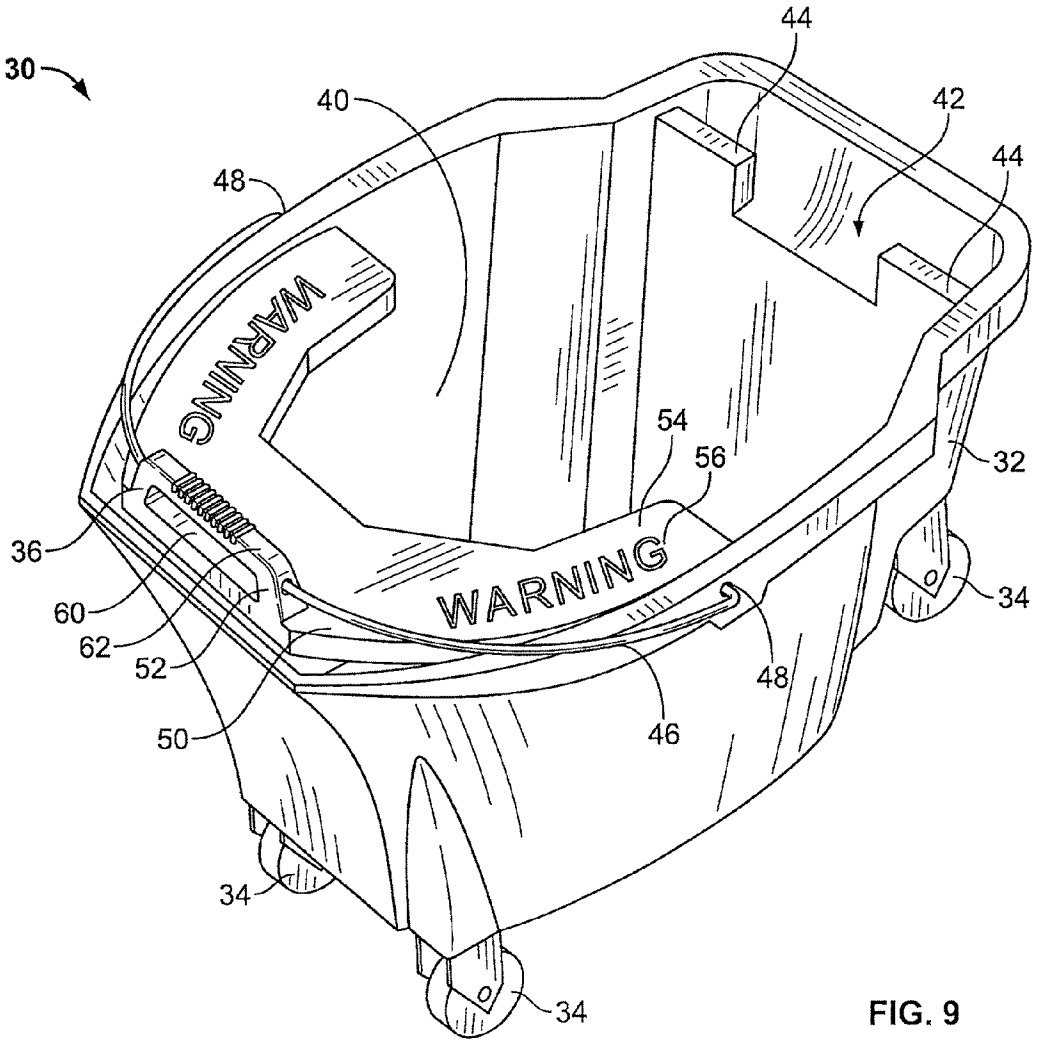
FIG. 9 is a front perspective view of a second embodiment of a mop bucket of the present invention.
Figure 11:
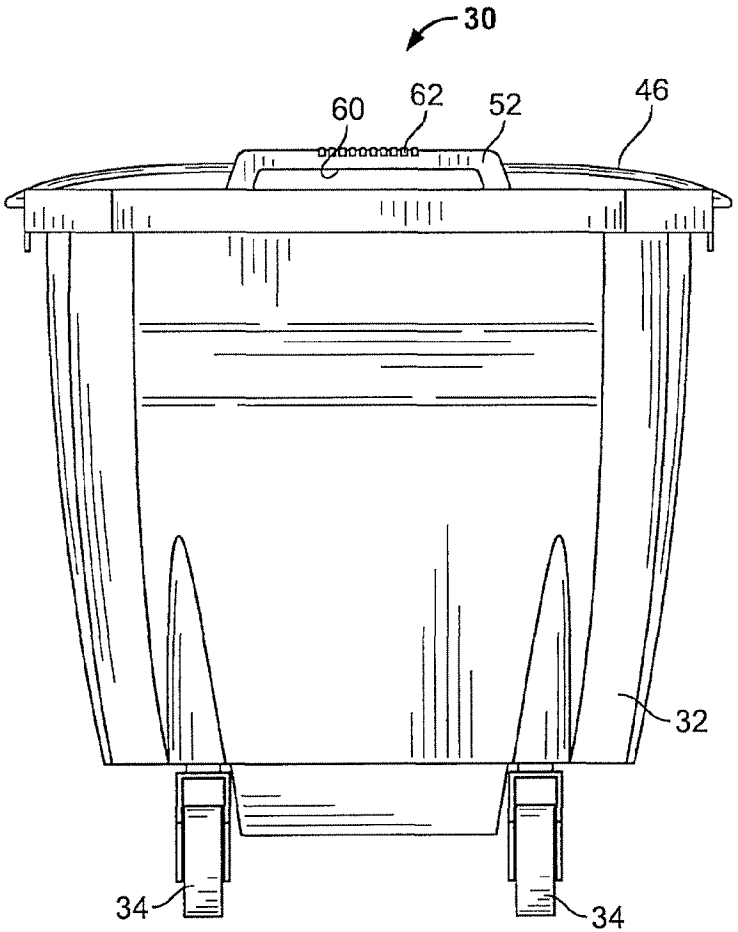
FIG. 11 is a rear elevational view of the second embodiment of the present invention.
Figure 10:
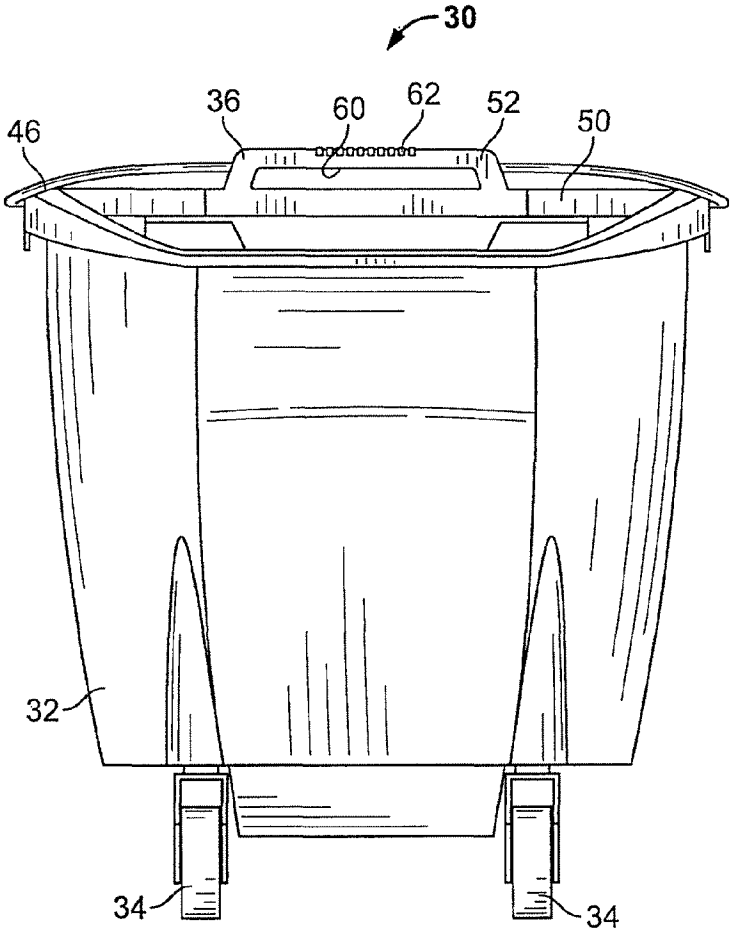
FIG. 10 is a front elevational view of the second embodiment of the present invention.
Figure 12:
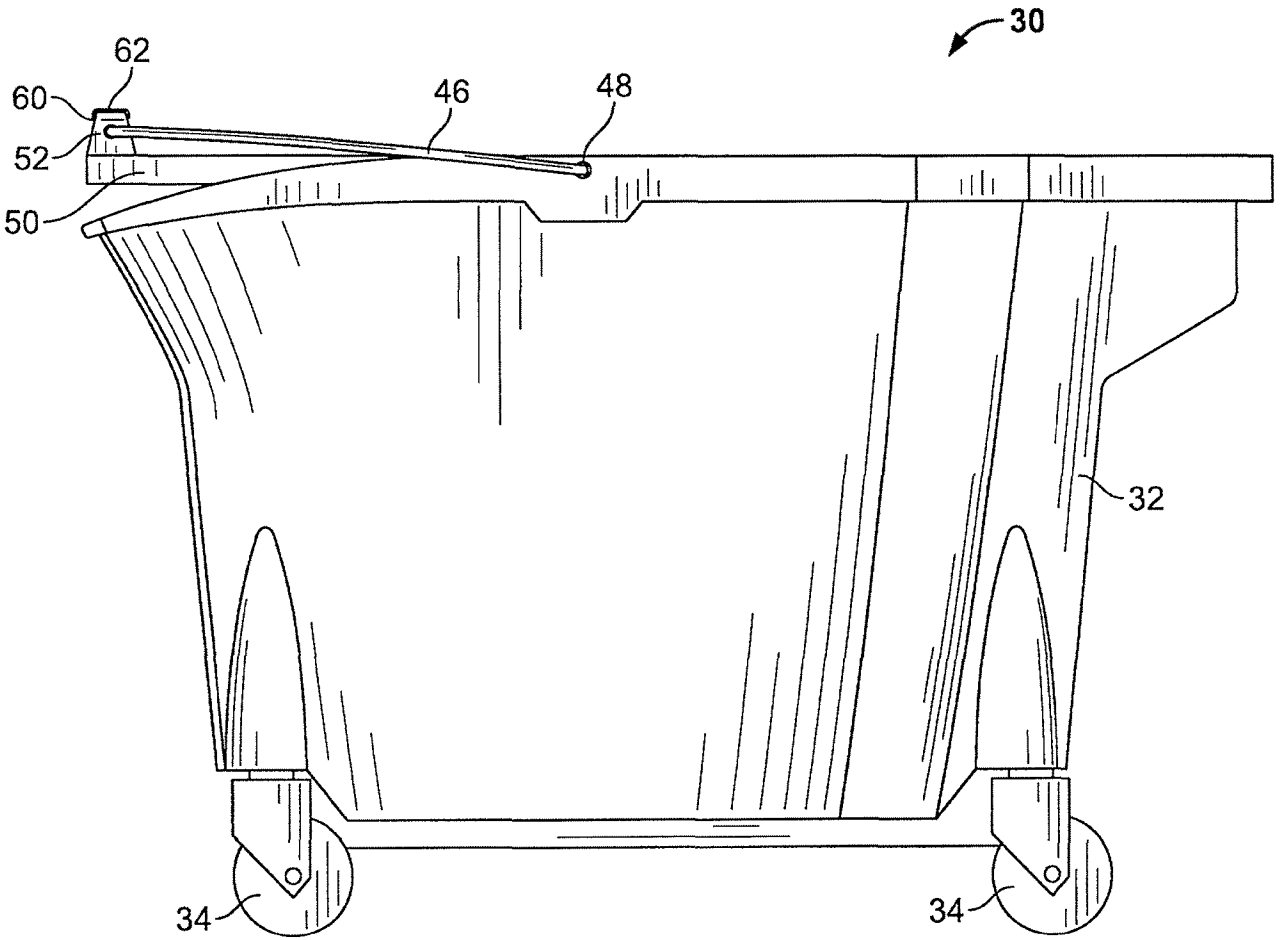
FIG. 12 is a right side elevational view of the second embodiment of the present invention.
Figure 13:
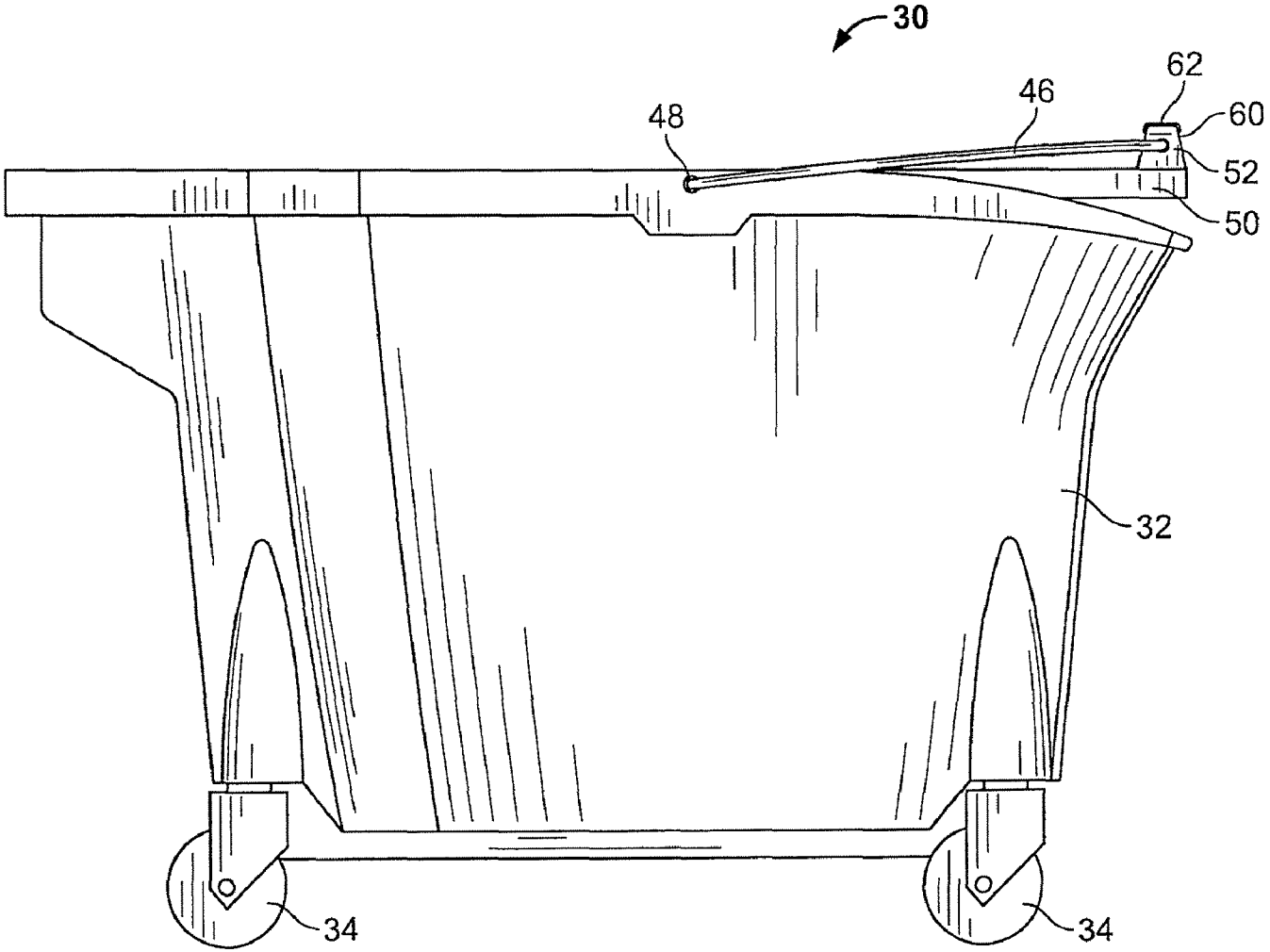
FIG. 13 is a left side elevational view of the second embodiment of the present invention.
Figure 14:
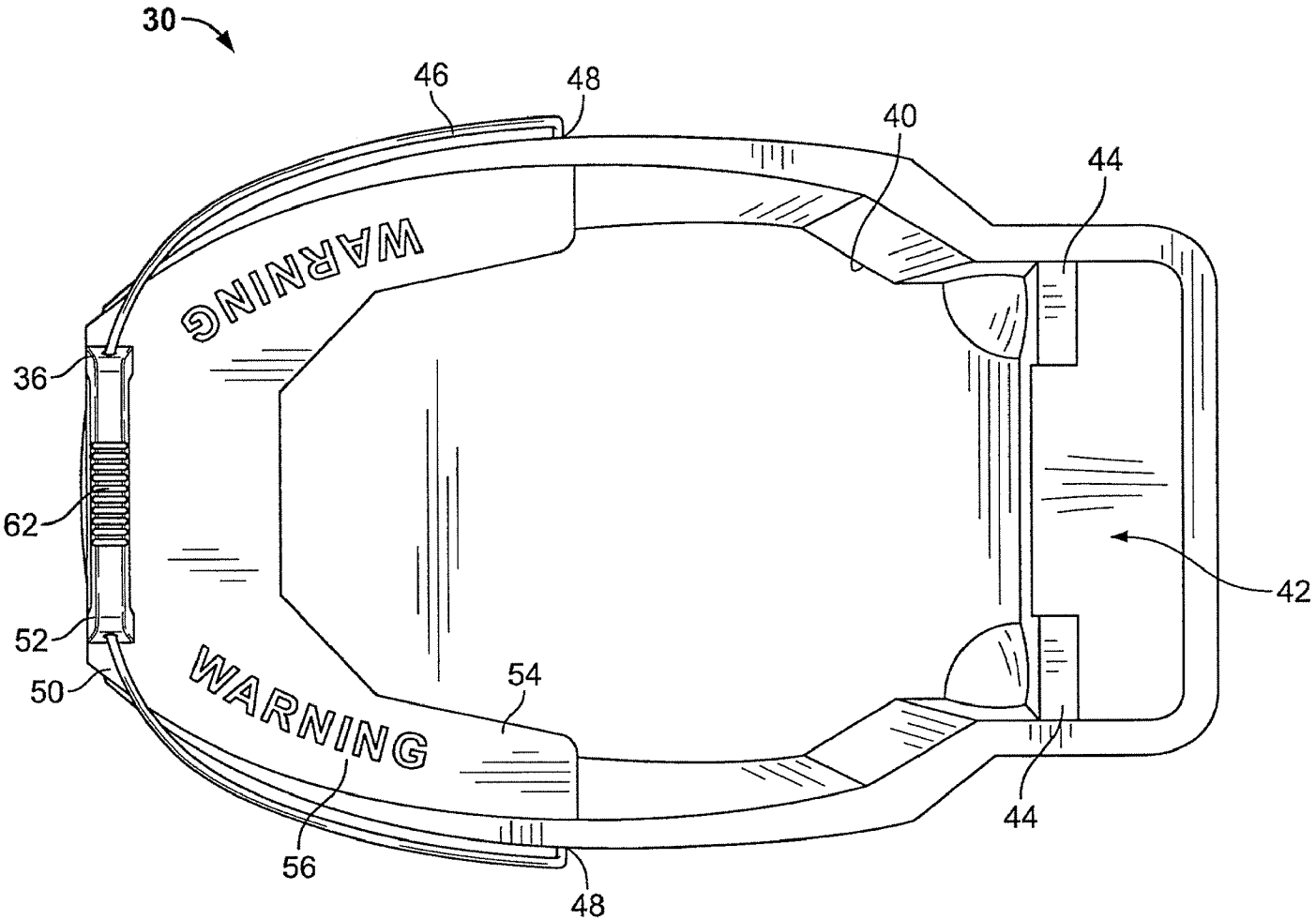
FIG. 14 is a top plan view of the second embodiment of the present invention.
Figure 15:
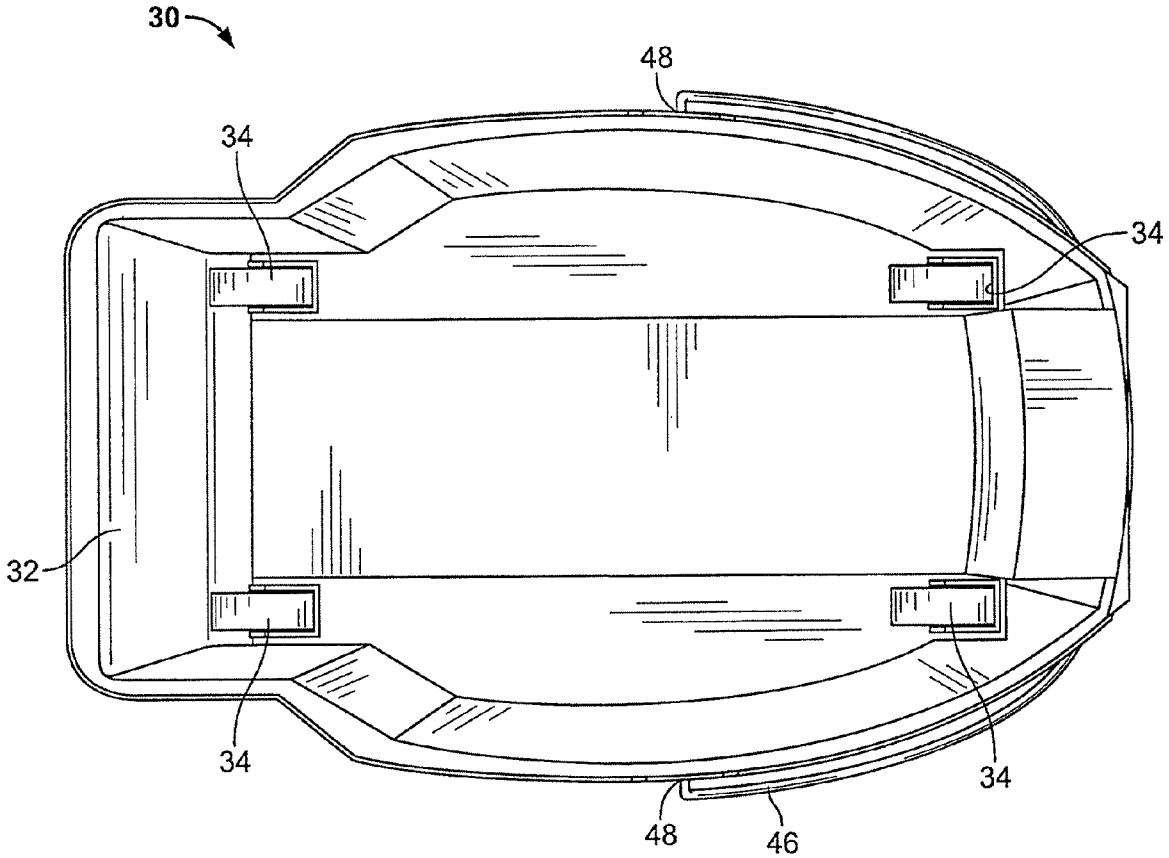
FIG. 15 is a bottom plan view of the second embodiment of the present invention.
Figure 16A:
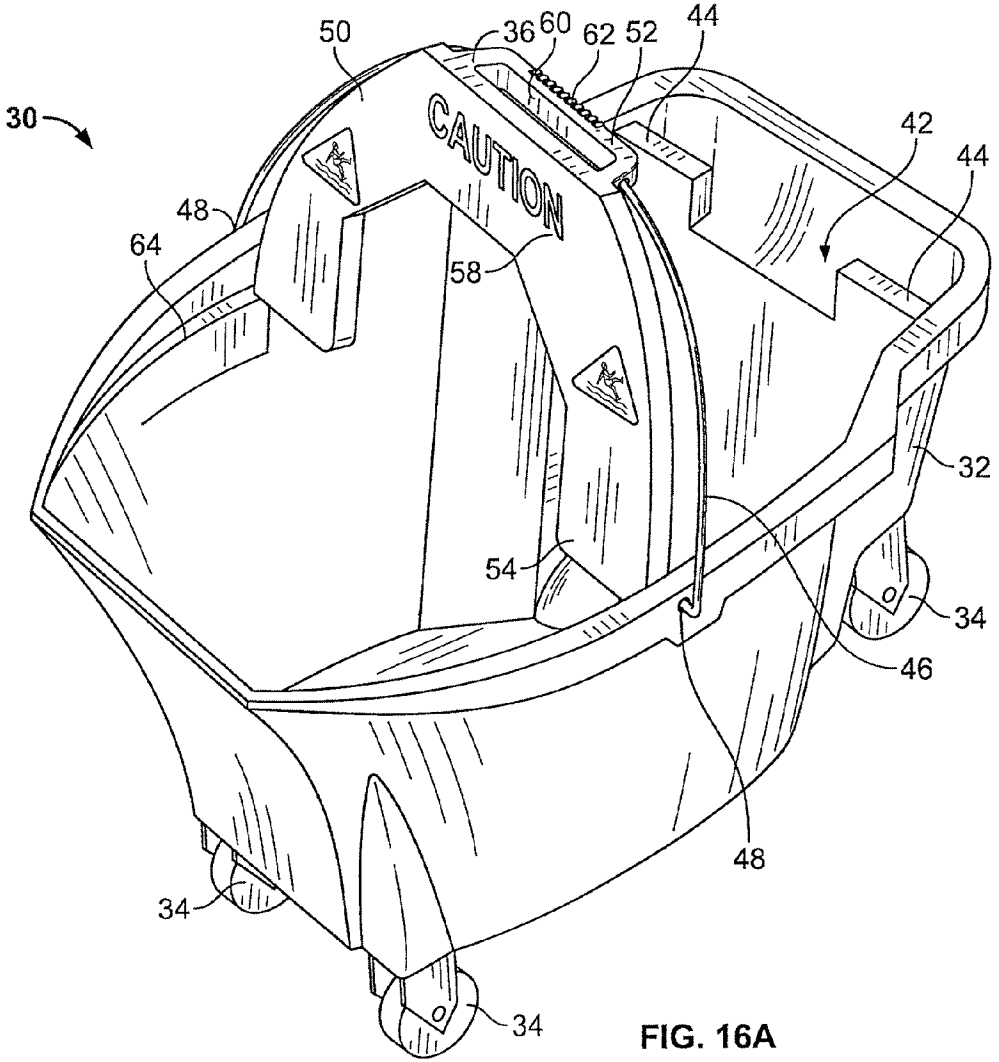
FIG. 16A is a front perspective view of the second embodiment of the present invention with a handle in an up position.
Figure 16B:
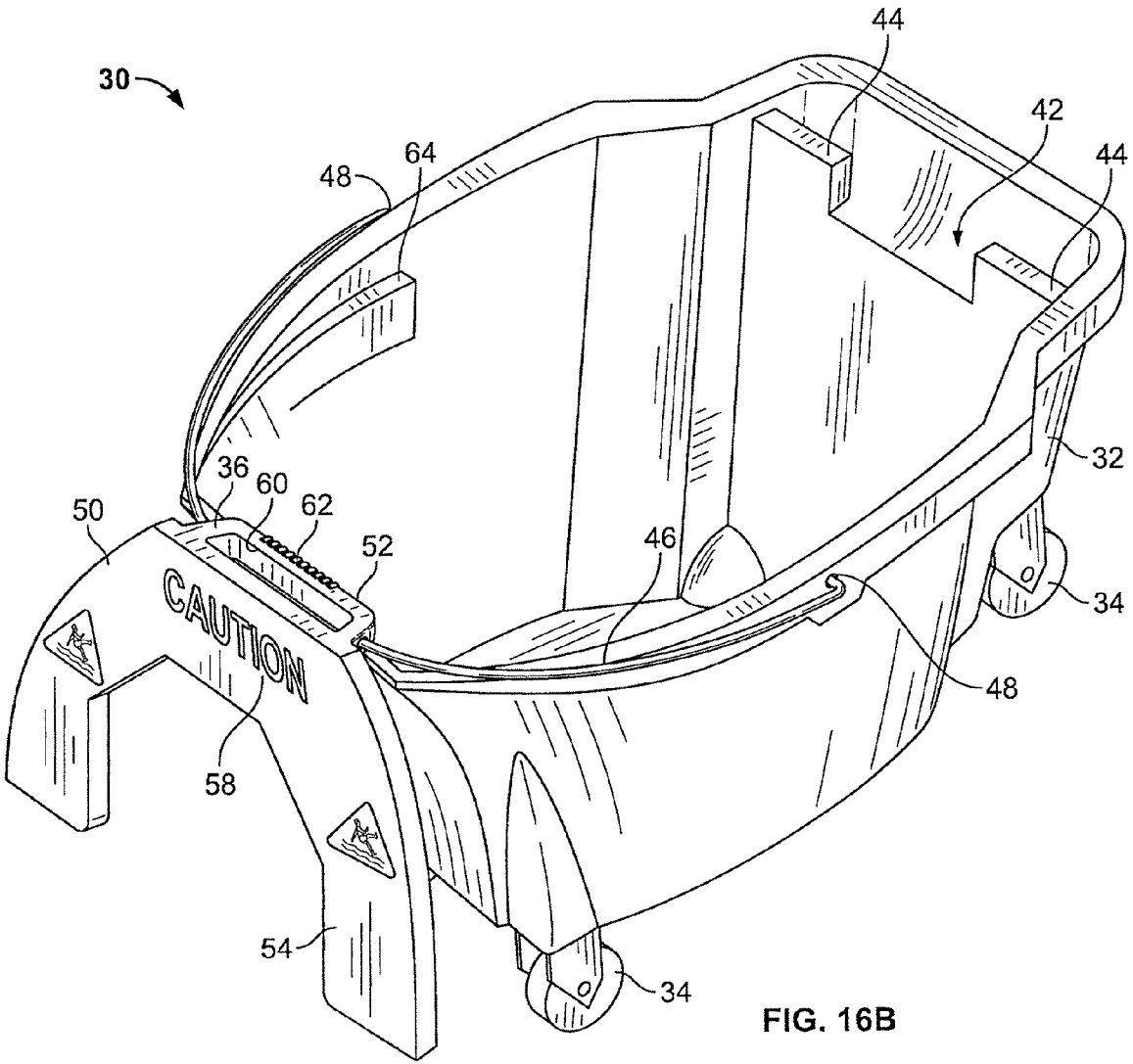
FIG. 16B is a front perspective view of the second embodiment of the present invention with a warning sign is deployed position.

Referring now to FIG. 8A, the mop bucket assembly 30 is depicted with the handle assembly 36 in an "up" or carrying position. In this position, a user can carry the bucket assembly 30 by first placing his hand in a recess 60 formed in the grip portion 52 and around a grip 62 and then lifting. Referring now to FIG. 8B, the mop bucket assembly 30 is depicted with the bucket assembly 30 in a use position. In this position, the lid portion 54 is flipped around the wire handle portion 46 and over the front of the bucket portion 32. The signage on the bottom surface 58 of the lid portion 54 is now visible, and in this embodiment, the signage on the bottom surface 58 acts as a "caution" sign. It should be understood though that any signage could be placed on either side of the lid portion 54. This signage could even include advertising, instead of warnings, by way of example. In FIG. 8B, a support ridge 64, for supporting the lid portion 54 in the traveling position, can be seen. It should be understood that the lid portion 54 can be supported in any number of ways, and it is not limited to being supported by a support ridge 64 as depicted. In the use position depicted in FIG. 8B, a user of the mop bucket assembly 30 has full access to the liquid retaining recess 40 with his mop. As such, the present invention allows full access to the bucket portion 32 for mopping in a use position (i.e. with the lid portion 54 flipped forward) and prevents spills when the mop bucket assembly 30 is in a traveling position (i.e. with the lid portion 54 covering the front of the liquid retaining recess 40).

Referring now to FIGS. 9-16B, an alternate, large embodiment of the mop bucket assembly 30 of the present invention is depicted. The large embodiment of the mop bucket assembly 30 operates in the same manner as described above for the small embodiment. The large embodiment of the mop bucket assembly 30 has a larger liquid retaining recess 40 compared to the smaller embodiment of the mop bucket assembly 30.

Figure 17A:
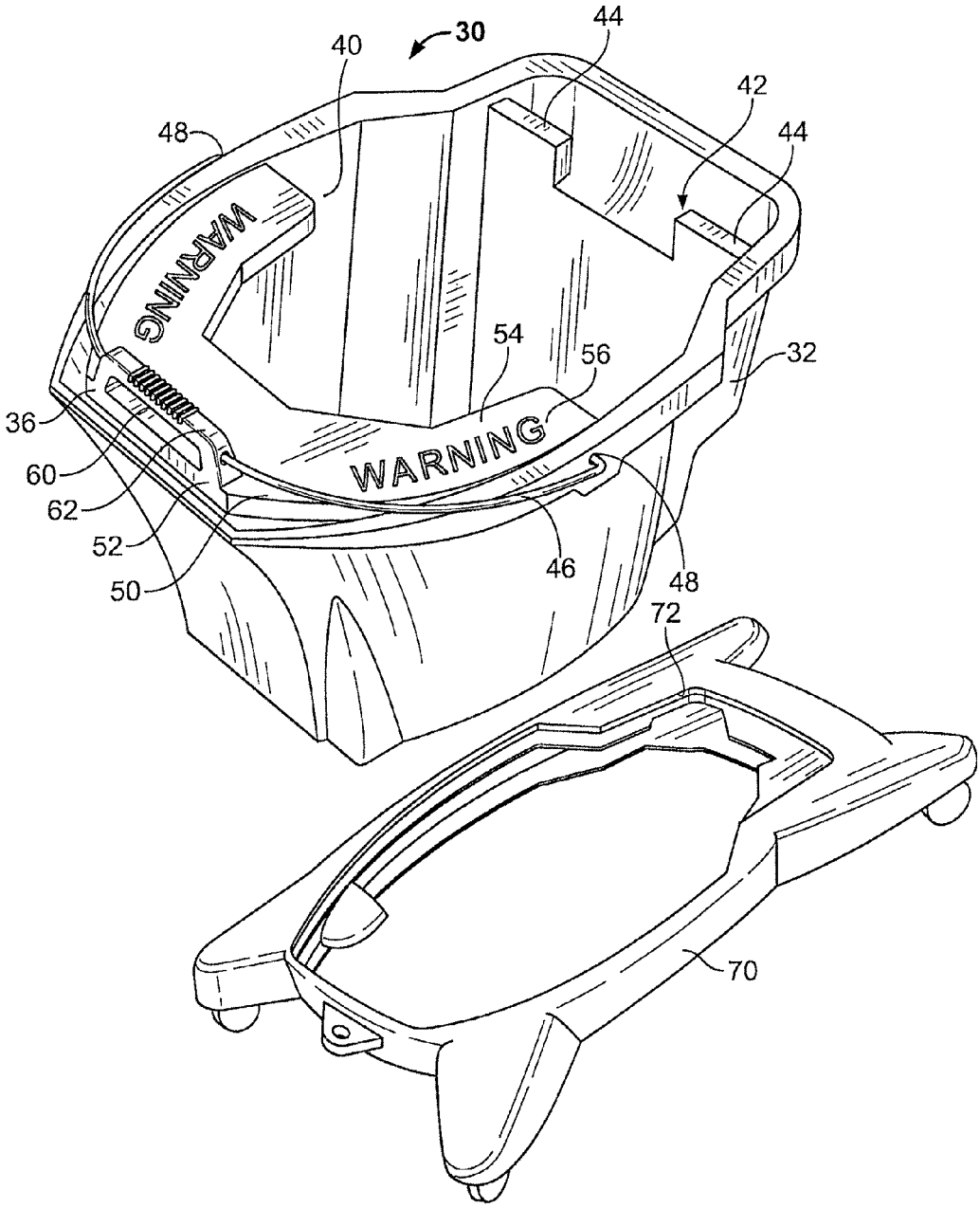
FIGS. 17A and 17B are a front perspective views of a third embodiment of a mop bucket and associated dolly.
Figure 17B:
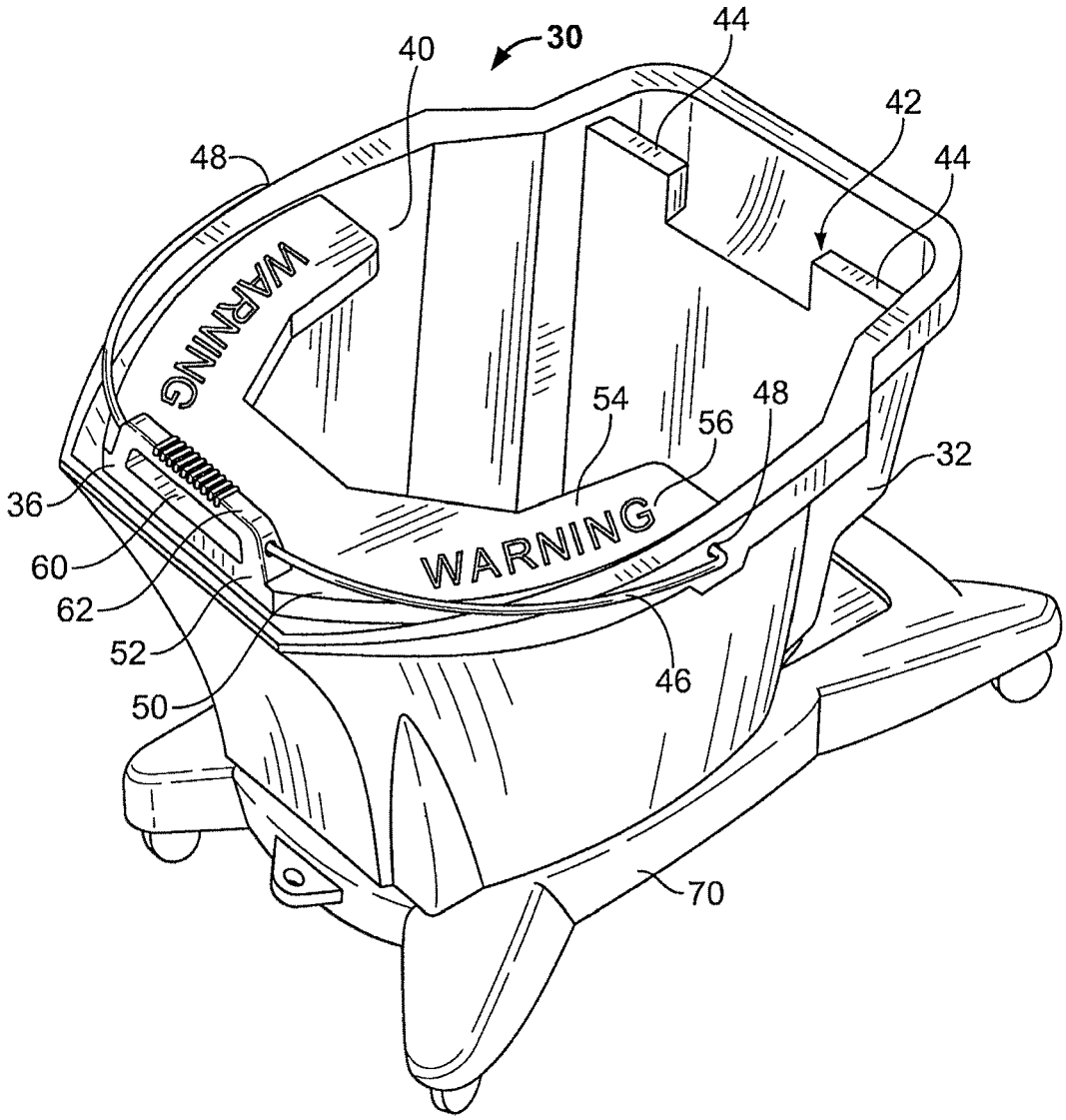
Figure 18:
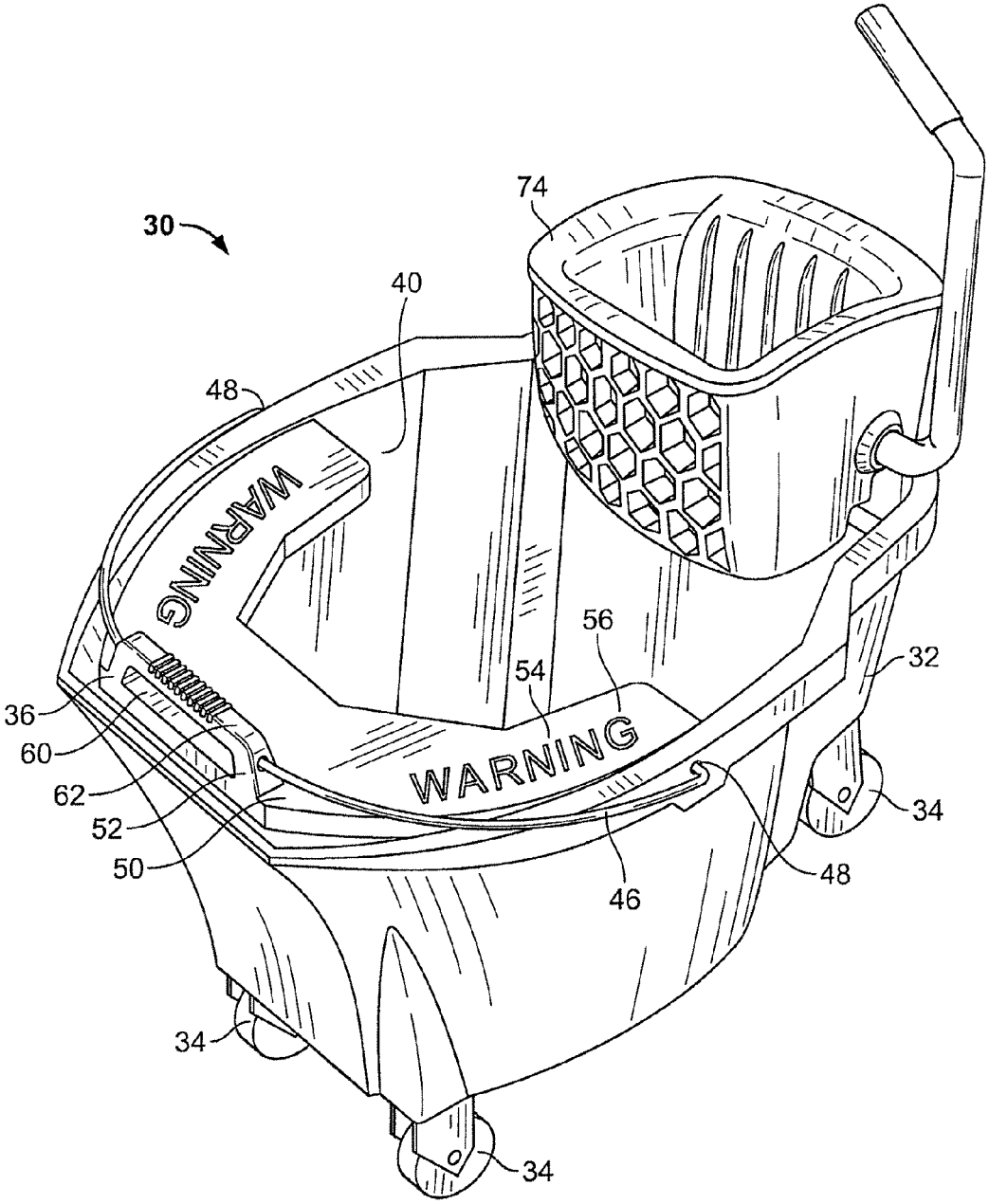
FIG. 18 is a front perspective view of the first embodiment of the present invention with a wringer in place.

Referring now to FIGS. 17A and 17B, an alternate embodiment of a mop bucket assembly 30 of the present invention is depicted. In this embodiment, the bucket assembly 30 does not have wheels 34, and a dolly 70 is used to move the bucket assembly 30 from point to point. The bucket assembly 30 fits into a recess 72 formed in the dolly 70. The dolly 70 can be formed with an upward extending support rack which can be used as a means for pushing the dolly or for holding a basket with cleaning supplies and products. FIG. 18 depicts a mop bucket assembly 30 of the present invention with a mop wringer 74 in place within the bucket portion 32 over the wringer support 42 towards the rear of the bucket portion 32. In this embodiment, the wringer 74 is positioned over the support protrusions 44.

Figure 19:
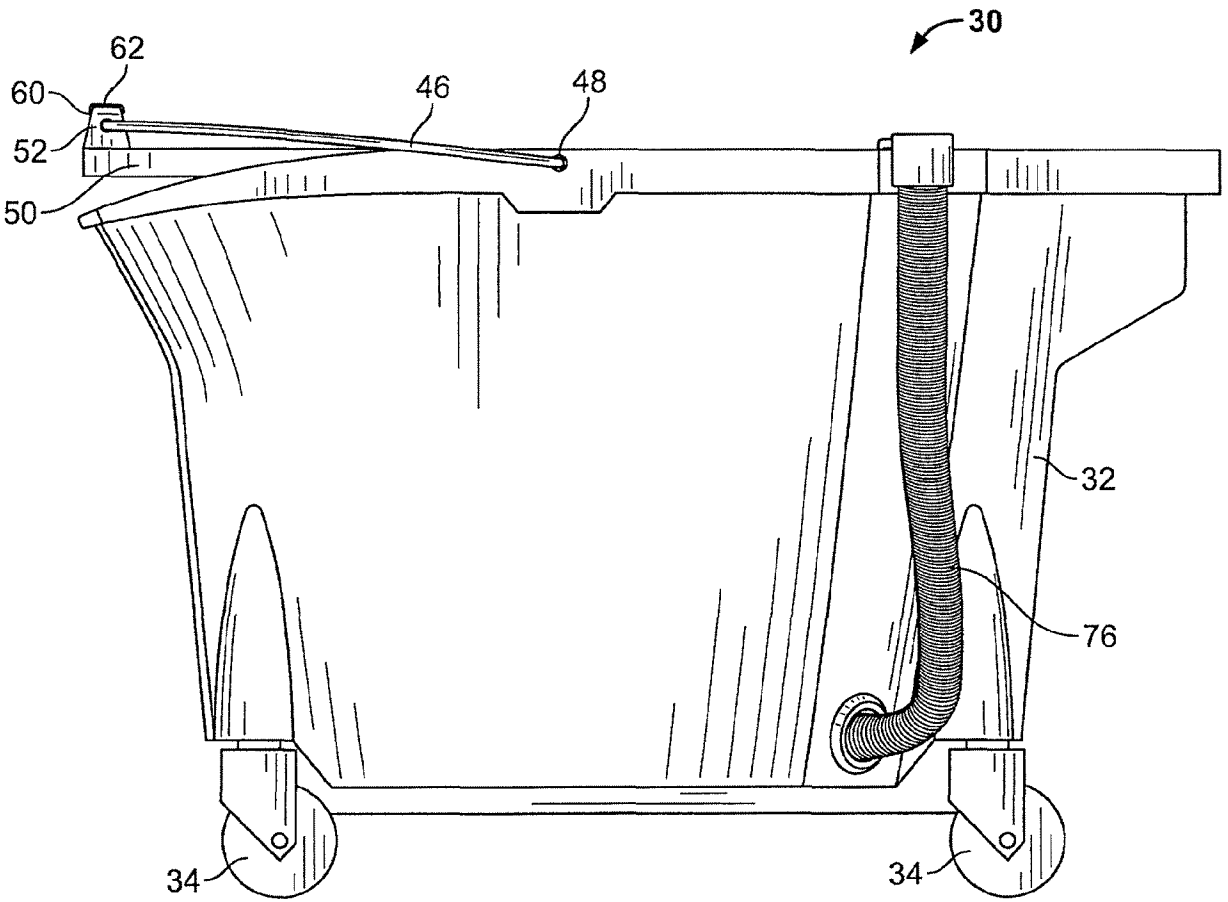
FIG. 19 is a right side elevational view of an alternate embodiment with a flexible drain tube in a storage position.
Figure 20:
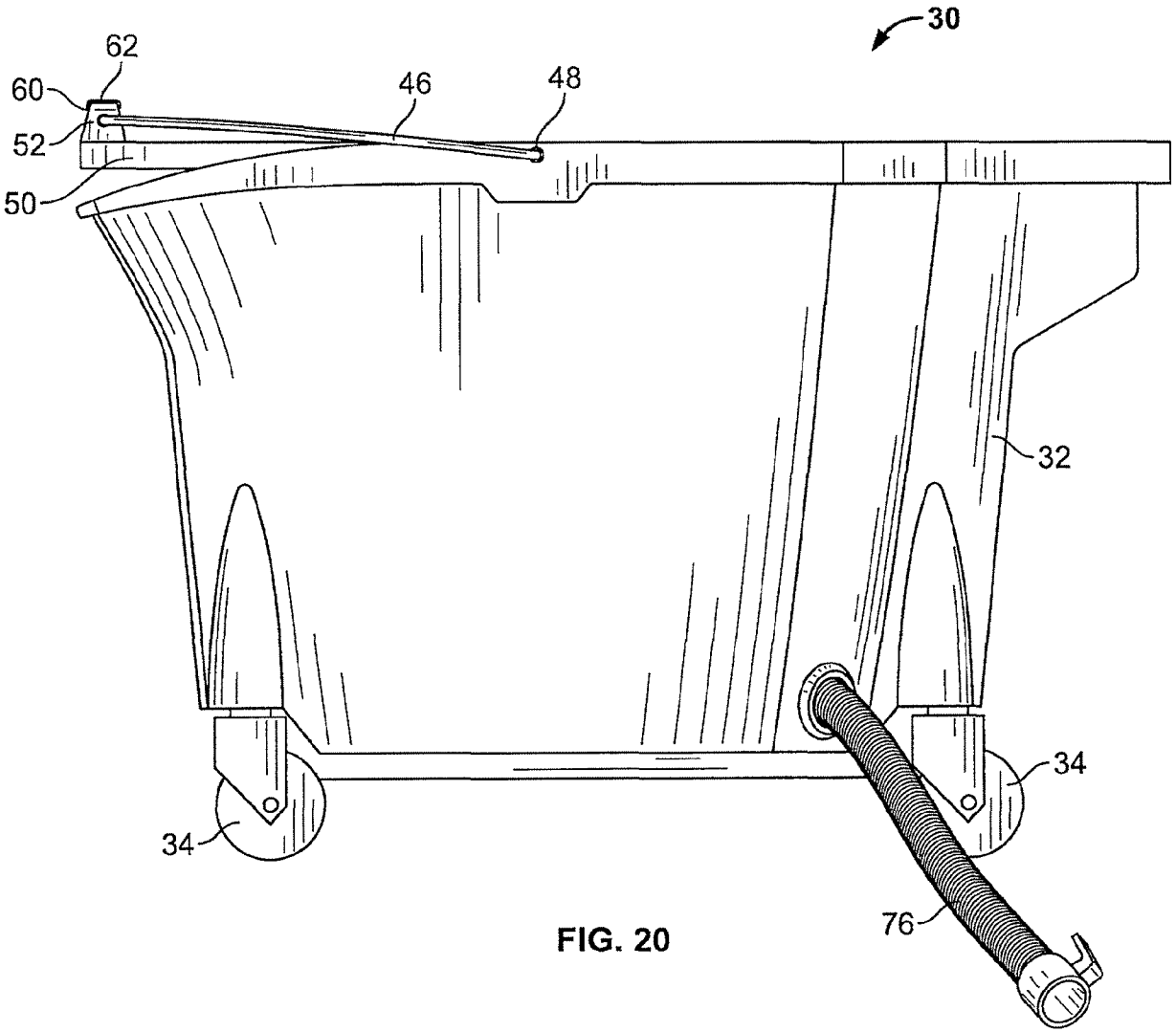
FIG. 20 is the alternate embodiment of FIG. 19 with the drain tube in a draining position.
Figure 21:
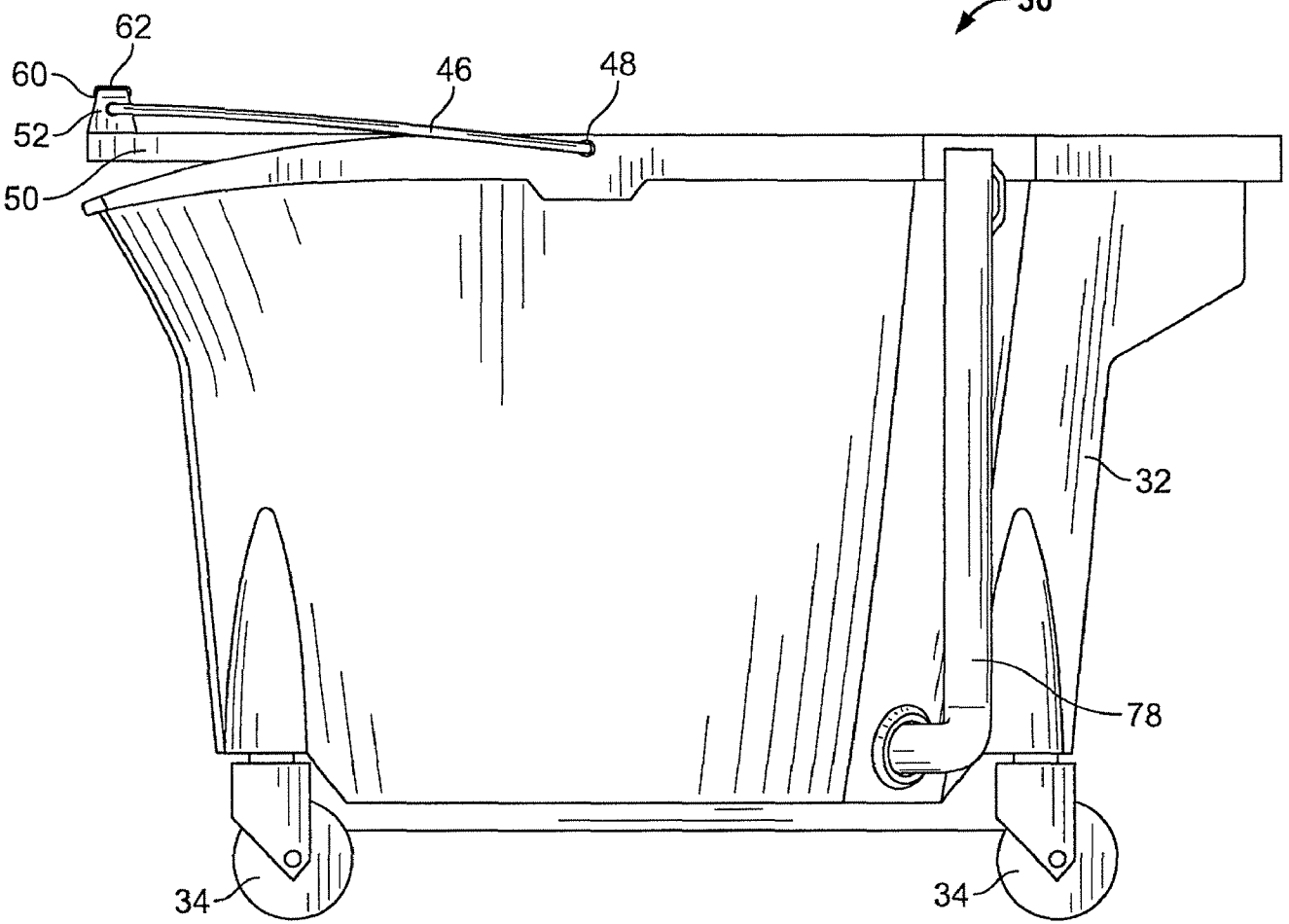
FIG. 21 is a right side elevational view of another alternate embodiment with a stiff drain tube in a storage position.

Referring now to FIGS. 19-21, alternative embodiments of the present invention with drain tubes 76 are depicted. In FIG. 19, a flexible drain tube 76 is depicted in a storage position. When a user wants to drain the bucket portion 32 of the mop bucket assembly 30, the user, in this embodiment, unclips the top of the flexible drain tube 76 from the bucket portion 32 and point it towards the drain or other spot where the user wants to drain the retained liquid to allow the bucket portion 32 to drain. FIG. 21 depicts an alternate embodiment of the mop bucket assembly 30 of the present invention with a stiff drain tube 78.

Obviously, many modifications and variations of the present invention are possible in light of the above teachings. Thus, it is to be understood that the invention may be practiced otherwise than as specifically described above.

What is claimed is:

1. A mop bucket assembly, comprising:

a bucket portion; the bucket portion having a front end, a back end and a liquid retaining recess enabled to receive a mop through an opening; and a handle assembly having a wire handle portion and a lid portion, the lid portion having at least one sign printed thereon, the wire handle portion having opposed ends pivotally connected to the bucket portion;

wherein the lid portion is pivotally connected to a portion of the handle between the ends of the wire handle and configured to alternate between a use position and a traveling position.

2. The mop bucket assembly of claim 1, wherein the mop bucket assembly further comprises a plurality of wheels on the underside of the bucket portion.

3. The mop bucket assembly of claim 1, wherein the mop bucket assembly further comprises a dolly for moving the mop bucket assembly from point to point.

4. The mop bucket assembly of claim 1, wherein the mop bucket assembly further comprises a mop wringer at the back end of the bucket portion.

5. The mop bucket assembly of claim 1, wherein the mop bucket assembly further comprises a support ridge at the front end of the bucket portion for supporting the lid portion in the traveling position.

6. The mop bucket assembly of claim 1, wherein liquid in the liquid retaining recess is retained within the bucket portion and restrained from spilling over sides of the bucket portion when the mop bucket assembly is moved while in the traveling position.

7. The mop bucket assembly of claim 6, wherein the lid portion is positioned along a portion of the liquid retaining recess opening's perimeter while in the traveling position to restrain liquid from spilling over a side of said bucket portion.

8. The mop bucket assembly of claim 7, wherein the lid portion covers a portion of a front end of the liquid retaining recess while in the traveling position.

9. The mop bucket assembly of claim 1, wherein access to the liquid retaining recess is unobstructed while in the use position.

10. The mop bucket assembly of claim 9, wherein the lid portion is flipped over the front end of the bucket portion in the use position.

11. The mop bucket assembly of claim 10, wherein at least one sign printed on an underside of the lid portion is visible in the use position.

12. The mop bucket assembly of claim 1, wherein the lid portion is configured to assume a carrying position, thereby adapted to enable a user to carry the mop bucket assembly by enabling placement of a hand in a recess formed in a grip portion and lifting.

13. The mop bucket assembly of claim 1, wherein the mop bucket assembly further comprises a drain for draining liquid contained in the bucket portion's liquid retaining recess.

14. The mop bucket assembly of claim 13, wherein the drain is a flexible drain tube and is placed in an upright storage position when not in use.

15. A mop bucket assembly, comprising:

a bucket portion; the bucket portion having a front end, a back end and a liquid retaining recess enabled to receive a mop through an opening;

a plurality of wheels positioned on an underside of the bucket portion;

a handle assembly, the handle assembly comprising a wire handle portion and a lid portion having at least one sign printed thereon, the wire handle portion having opposed ends pivotally connected to the bucket portion;

wherein the lid portion is pivotally connected to the bucket portion via the wire handle and configured to alternate between a use position and a traveling position; and a support ridge at the front end of the bucket portion for supporting the lid portion while in the traveling position;

wherein the lid portion restrains liquid contained in the liquid retaining recess from spilling over sides of the bucket portion when the mop bucket assembly is moved while in the traveling position;

wherein the lid portion is flipped via said pivotal connection over the front end of the bucket portion while in the use position, thereby providing unobstructed access to the mop bucket liquid and causing the sign to be visible.

16. The mop bucket assembly of claim 15, wherein the mop bucket assembly further comprises a mop wringer at the back end of the bucket portion.

17. The mop bucket assembly of claim 15, wherein the mop bucket assembly further comprises a drain for draining the liquid contained in the bucket portion's liquid retaining recess.

18. The mop bucket assembly of claim 15, wherein the mop bucket assembly further comprises a dolly for moving the mop bucket assembly from point to point.

19. A handle assembly for reducing liquid spillage is a mop bucket, comprising:

a wire handle portion that pivotally couples with the mop bucket through holes formed in the mop bucket; and a lid assembly having a grip portion and a lid portion;

wherein the lid portion has at least one sign printed thereon;

wherein the lid portion is pivotally connected to a portion of the handle between opposed ends of the wire handle and configured to alternate between a use position and a traveling position;

wherein the lid portion restrains liquid from spilling over sides of the mop bucket when moved while in the traveling position;

wherein the lid portion is flipped over a front of the bucket while in the use position, thereby providing unobstructed access the mop bucket liquid while causing the sign to be visible.

* * * * *